United States Patent [19]

Heng et al.

[11] Patent Number: 4,693,542

[45] Date of Patent: Sep. 15, 1987

[54] ELECTRICAL SCREW CONNECTION

[75] Inventors: Jean-Paul Heng, Lyons; André Marmonier, Bron; Ariel Ruiz, Villeurbanne; Henri Guernet, Lyons, all of France

[73] Assignee: Cgee Alsthom, Levallois-Perret, France

[21] Appl. No.: 808,698

[22] Filed: Dec. 12, 1985

[30] Foreign Application Priority Data

Dec. 12, 1984 [FR] France ..... 84 18998

[51] Int. Cl.[4] ..... H01R 4/36

[52] U.S. Cl. ..... 439/626; 439/709; 439/810

[58] Field of Search ..... 339/272 R, 272 A, 272 B, 339/272 UC, 198 R

[56] References Cited

U.S. PATENT DOCUMENTS

| | | | |
|---|---|---|---|
| 2,732,535 | 1/1956 | Hammerly | 339/272 UC |
| 3,464,055 | 8/1969 | Lescarboura | 339/204 |
| 3,707,698 | 12/1972 | Robinson et al. | 339/272 R |
| 3,775,733 | 11/1973 | Ege | 339/272 R |
| 4,472,011 | 9/1984 | Durkop | 339/198 R |

FOREIGN PATENT DOCUMENTS

| | | | |
|---|---|---|---|
| 1915865 | 10/1970 | Fed. Rep. of Germany . | |
| 2551300 | 4/1977 | Fed. Rep. of Germany | 339/272 R |
| 2221827 | 10/1974 | France . | |
| 2520561 | 7/1983 | France . | |

*Primary Examiner*—Gil Weidenfeld
*Assistant Examiner*—Gary F. Paumen
*Attorney, Agent, or Firm*—Sughrue, Mion, Zinn Macpeak & Seas

[57] ABSTRACT

A connection, in particular of the miniature type for providing oblique connections at angles which may be selected over a wide range of angles on request. Said connections serving to put a conductor wire (3) into electrical connection with a conductor strip (4) of an electrical apparatus by gripping the wire between a wire-gripping surface (41) provided on the strip and a corresponding parallel, internal, wire-gripping surface (10) of a cage (1) which surrounds the strip, said grip being provided by the action of a clamping screw (2) screwed into the cage and bearing against the opposite surface of the strip from its wire-gripping surface. The clamping screw is disposed obliquely relative to the wire-gripping surfaces and its end presses directly on said opposite surface (22); the cage (1) includes at least one lateral screw-backing element (11) in the vicinity of the end (21) of the screw where it is pressed against the strip.

5 Claims, 7 Drawing Figures

ELECTRICAL SCREW CONNECTION

The present invention relates to electrical screw connections, in particular miniature connections, for putting a conductor wire into connection with a conductor strip in electrical apparatus, and more particularly it relates to electrical connections in which the wire to be connected is inserted at an angle relative to the axis of the clamping screw which is used for gripping the wire.

BACKGROUND OF THE INVENTION

Generally speaking, electrical connection manufacturers have to comply with the constraints imposed by the apparatuses on which the connections they manufacture are to be located, and with the methods of cabling intended for use with such apparatuses.

Where appropriate, it is thus advantageous to have types of connection which are suitable for being adapted to specific requirements without having to be redesigned from scratch. In particular, it is advantageous to have as wide a degree of freedom as possible in selecting the orientation of the insertion axis of the conductor to be connected relative to the operating axis of the connection.

Thus, connections exist for axial connection in which the insertion axis of the wire is at a chosen acute angle relative to the axis of a clamping screw which conventionally displaces a wedging shoe mounted on the screw in such a manner as to move obliquely relative to a conductor strip in a cage; with the wire being inserted between the shoe and the strip prior to being clamped by the screw. An example of such a connection is described in the Applicants' published French patent specification number 2 520 561.

These axial connections facilitate connection so long as the acute angle remains small and the sizes of the component parts remain sufficiently large, however, they suffer from drawbacks when used as miniature connections or when the acute angle is relatively large.

Screw connections also exist in which the wire insertion axis is perpendicular to the axis of a clamping screw which grips the wire between a wire-gripping surface provided on a conductor strip and a corresponding internal wire-gripping surface which is at least approximately parallel thereto on a cage. The cage surrounds the strip and is suitable for gripping the wire under the action of the clamping screw which is screwed through the cage and which bears against the strip from the other side thereof relative to the wire and the wire-gripping surfaces.

Unless modified, this type of connection does not allow for the wire to be inserted at an angle, whereas its simplicity makes it well adapted to miniaturization, and it has the advantage of allowing a wire to be inserted along either one of two opposite directions, unlike the other system described above.

Preferred embodiments of the present invention thus propose a connection derived from the above-described connection after modification to allow connection directions and consequently wire insertion directions relative to the clamping screw axis to be obtained on request over a range of acute and obtuse angles which are at least somewhat oblique, i.e. which are preferably greater than thirty degrees and less than one hundred and fifty degrees.

SUMMARY OF THE INVENTION

The present invention provides a screw connection for putting a conductor wire into electrical connection with a conductor strip of an electrical apparatus, said screw connection comprising a cage suitable for placing around said conductor strip and a clamping screw screwable into said cage, and said conductor strip having a screw-engaging surface on one side thereof and a wire-gripping surface on an opposite side thereof, said screw having a leading end disposed, when said screw is screwed into said cage, to thrust against said screw-engaging surface of said conductor strip in order to electrically connect said conductor wire to said conductor strip by gripping said wire between said wire-gripping surface of said conductor strip and a facing, inside, wire-gripping surface of said cage, extending generally parallel to said wire-gripping surface of said conductor strip, said clamping screw having a screw axis which extends at an angle relative to said generally parallel wire-gripping surfaces, and said cage including at least one lateral screw-backing element for engaging said clamping screw at least in the vicinity of its leading end to oppose the transverse component of the reaction between said screw and said connector strip tending to urge said leading end of said screw sideways while said screw is being tightened by virtue of said angle between said screw and said screw-engaging surface of said strip.

Advantageously, said cage is made of cut and folded metal sheet and comprises a pair of parallel webs interconnected at one end by an obliquely disposed web providing said wire-gripping surface of said cage, and interconnected at an opposite end by at least one web which extends perpendicularly to said pair of parallel webs and which includes a tapped hole to hold and position said clamping screw so that it extends parallel to said pair of parallel webs, each of said parallel webs each including a lateral projection folded against the shank of the screw at least in the vicinity of its leading end pressed against said conductor strip in order to constitute one of said lateral screw-backing elements and to avoid setting up a rotary couple between said screw shank and said conductor strip.

BRIEF DESCRIPTION OF THE DRAWINGS

An embodiment of the invention is described by way of example with reference to the accompanying drawings, in which.

DESCRIPTION OF THE PREFRRED EMBODIMENT

Figure 1:
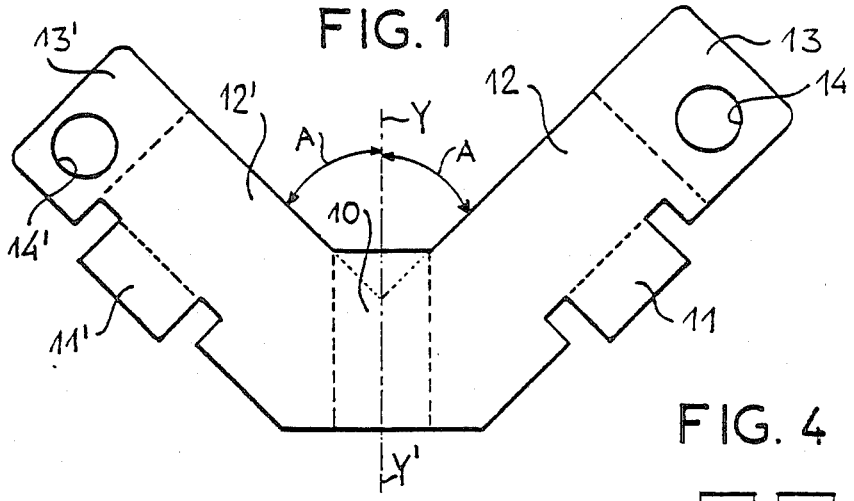
FIG. 1 shows a blank for making the connection cage of an electrical screw connection in accordance with the invention.
Figure 2:
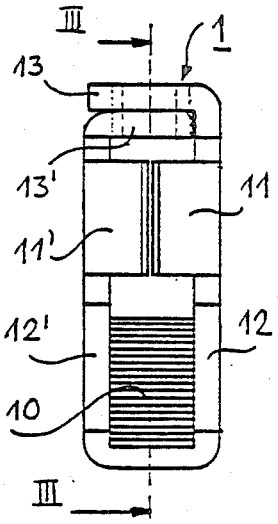
FIG. 2 is a front view of the cage made from the FIG. 1 blank.
Figure 6:
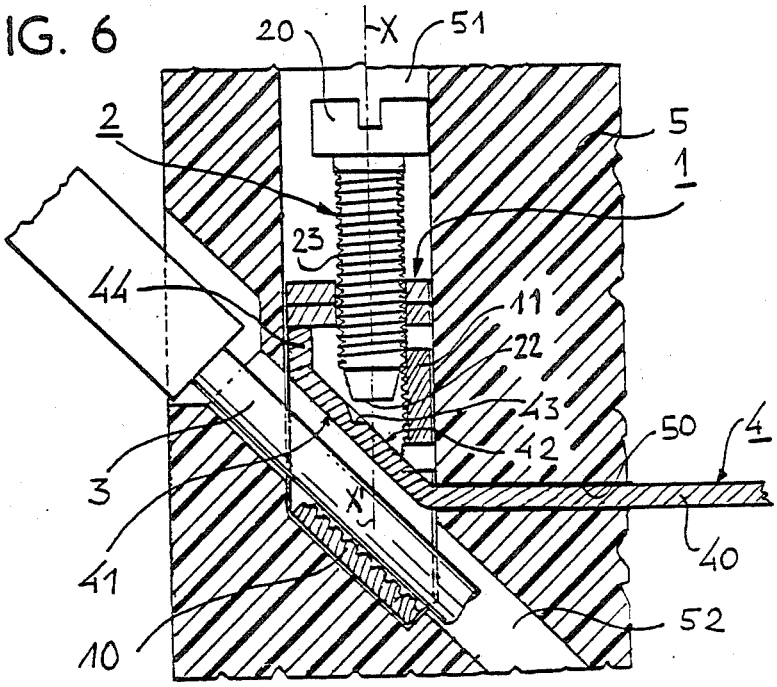
FIGS. 6 and 7 are sections through an electrical screw connection using the components shown in the preceding figures.
Figure 7:
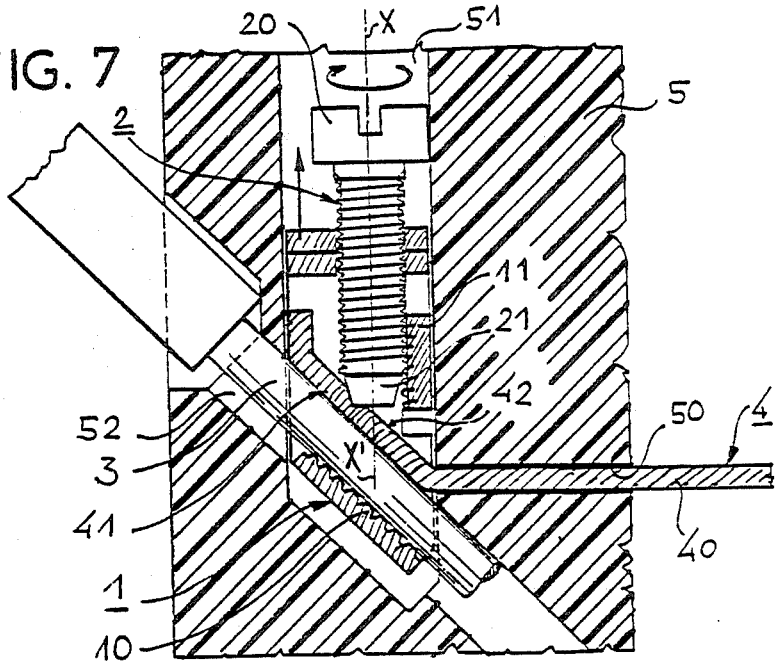

The blank shown in FIG. 1 is conventionally obtained by being cut out from metal sheet, and it is intended to make a cage such as the cage shown in FIG. 2, by means of successive folding operations. The cage is intended to co-operate with a clamping screw 2 in order to connect a conductor wire 3 to a conductor strip 4 as can be seen in the embodiment shown in FIGS. 6 and 7.

The conductor strip 4 is of rectangular section in the conventional way and serves electrical apparatus (not shown) which is at least partially contained in a housing 5 made of insulating material and in which the strip 4 is lodged and held, being kept in place, for example, by an intermediate portion 40 in a duct or channel 50 provided therefor.

The cage 1 as obtained from the blank surrounds the strip 4 in such a manner as to enable the conductor wire 3 to be gripped by being jammed between an internal wire-gripping surface 10 on the cage and a facing wire-gripping surface 41 on the strip 4. The conductor wire 3 is gripped between the wiregripping surfaces 10 and 41 by the clamping screw 2 being screwed into the cage 1. The screw 2 passes through the cage and bears against a screw-engaging surface of the strip 4 on its side opposite to the wire-gripping surfaces 41 and 10.

In the embodiment shown, the cage 1 which is moved relative to the strip 4 by the screw 2, is lodged in a duct 51 provided through the housing 5 in such a manner as to allow limited displacement of said cage relative to the strip, along the axis of the clamping screw and perpedicularly in this case to the intermediate portion 40 of said strip.

The duct 51 is open at at least one end in such a manner as to allow a screwdriver (not shown) to be inserted therein in order to turn the head 20 of the screw 2. The duct 51 intersects both the duct 50 through which the strip 4 passes and a duct 52 to allow the conductor wire 3 to be inserted into the housing 5 as far as between the wire-gripping surfaces 10 and 41 of the screw connection.

As mentioned above, the aim of the invention is to make it possible to obtain as wide as possible a range of oblique angles between the axis of the clamping screw and the direction of wire insertion and connection, and consequently to obtain as wide as possible a range of directions for the duct 52. This range should be obtainable on request without requiring new technical solutions to be developed and implemented.

In the embodiment shown, the portion of the strip 4 which is surrounded by the cage 1 and which includes the wire-gripping surface 41 is disposed obliquely relative to the intermediate portion 40.

The axis of the duct 52 is preferably chosen to be parallel to said portion of the strip 4 having the wire-gripping surface 41, and the opening of the duct 52 opposite the wire-gripping surfaces 10 and 41 should be level at its edges firstly with the wire-gripping surface 41 and secondly with the wire-gripping surface 10 of the cage 1, when said cage is in that one of its two extreme positions in which the wire-gripping surfaces are furthest apart, with the screw 2 being unscrewed.

In the embodiment shown, in which the wire-gripping surfaces 10 and 41 are at least approximately and preferably parallel, the duct 52 may be provided in such a manner as to open out on one and/or the other side of the cage 1 in order to allow wire insertion along one or other of two opposite directions, one of which is at an acute angle and the other of which is at the obtuse angle which is supplementary to said acute angle.

The end 21 of the clamping screw bears directly on the screw-engaging surface 42 of the strip 4 opposite to the wire-gripping surface 41. Unless special precautions are taken, the screw tends to be deflected while it is being tightened against the screw-engaging surface 42 which is disposed obliquely relative thereto, and the smaller the oblique angle the greater the deflection effect.

In accordance with the invention, the cage 1 therefore includes at least one lateral screw-backing element 11 against which the screw 2 comes into contact sideways at least in the vicinity of its end 21, said lateral screw-backing element 11 opposing the deflection reaction which tends to urge the end of screw sideways while it is being tightened. Each lateral screw-backing element is preferably positioned in such a manner as to have its closest portion to the strip at substantially the same level as the region where the screw bears against the strip when the screw is being clamped onto to a conductor wire, thereby avoiding setting up a rotary couple on the cage relative to the strip.

In addition, the screw-engaging surface 42 of the strip may be provided with a bearing joggle 43 for positioning the end 21 of the screw on the screw-engaging surface when it begins to bear thereaginst as it is being tightened.

In the embodiment shown, the screw 2 has chamfered end 21 which terminates in a plane circular zone 22 which is perpendicular to the longitudinal axis of the screw (see FIG. 3) so as to press against the bearing joggle 43 in two distinct directions; the axial direction, and a sideways direction. The slope of the chamber defines the direction of the sideways thrust on the screw and may thus be adjusted as a function of the slope of the screw axis XX′ relative to the portion of the strip having the surfaces 42 and 43.

The bearing joggle 43 is, for example, conventionally stamped as a recess or as a projection when the strip is formed, and it may be observed in the embodiment shown that the end of the strip is folded in such a way as to avoid catching the conductor wire 3 on the end of the strip when the wire is inserted.

In the embodiment shown in FIG. 1, the blank for making the cage 1 is shaped by being folded about a central portion which is preferably grooved in order to constitute the internal wire-gripping surface 10, with the grooves having the purpose of improving the grip on the conductor wire. This central portion is intended to be disposed obliquely relative to the remainder of the cage 1 and to be pressed against the wire-gripping surface of a strip, and it therefore defines the connection obliqueness of the cage. The blank from which it is made extends on either side from said central portion in the form of two webs 12, 12′ which are symmetrically disposed about a median axis YY′ at an angle A equal to the desired obliqueness.

It is thus possible to vary the angle of the connection direction relative to the screw axis by modifying the angle obtained between the webs 12 and 12′ when the blank is cut out.

In the embodiment shown in FIGS. 1 to 4, the two webs 12 and 12′ are folded into planes perpendicular to the plane defined by the central portion 10, so as to be parallel to each other. The free end 13, 13′ of each of said webs is then folded back perpendicularly so as to form a web 13, 13′ of double thickness, with a hole 14, 14′ being previously made through each extension in order to provide a tapped hole 14, 14' from the combination thereof, in order to receive the clamping screw 2.

The screw-backing elements 11 and 11' are constituted by respective lateral extensions provided by cutting out extensions on the outside of the parallel webs 12 and 12' prior to folding the blank. These lateral extensions are folded towards each other towards the inside of the cage in order to serve as a backing surface for the shank 23 of the screw 2. This backing surface should be effective at least in the vicinity of the region where the end 21 of the screw bears against the strip.

Figure 4:
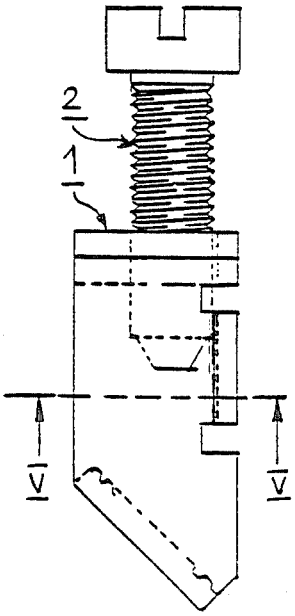
FIG. 4 is a side view showing a screw mounted in the FIG. 2 cage.
Figure 3:
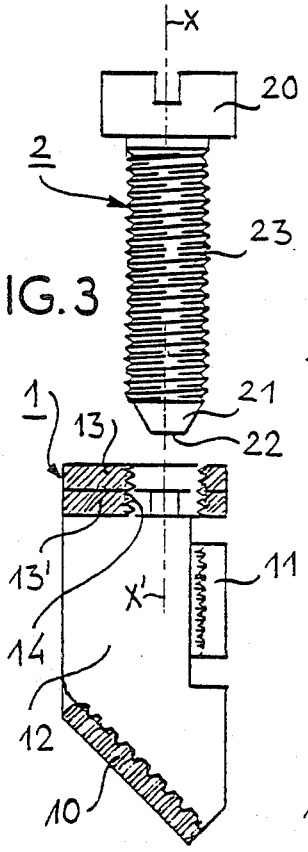
FIG. 3 is a section on III—III through the cage shown in FIG. 2, with a clamping screw shown thereabove.

In the embodiment shown, this backing surface extends over a relatively large width of the screw 2 as can be seen in FIGS. 3 and 4. The screw 2 then serves to make the cage more rigid and consequently to make the screw connection stronger, while still enabling keeping its size to a minimum.

Figure 5:
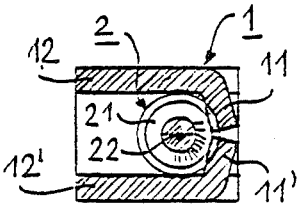
FIG. 5 is a section on V—V of the assembly shown in FIG. 4.

In an embodiment more particularly adapted to miniature type screw connections, the inside space of the cage is designed in such a manner that the tapping through the webs 13 and 13' bites partially into the insides of the extensions 11 and 11' and optionally also into the insides of the parallel webs 12 and 12', as can be seen in FIG. 5. This improves the results mentioned above by avoiding damage to the threads of the screw 2 which bear at least against said extensions, and maybe against the parallel webs.

We claim:

1. A screw connection which places a conductor wire into electrical connection with a conductor strip of an electrical apparatus at least partially contained in a housing made of insulating material, said housing including a first duct and an oblique second duct, said oblique second duct intersecting said first duct at an acute angle at one end to close off said one end of said first duct, said screw connection comprising:

a cage including an inside wire-gripping surface, a clamping screw screwably mounted to said cage, said conductor strip having a screw-engaging surface on one side thereof and a wire-gripping surface on an opposite side thereof facing said cage wire-gripping surface, said screw having a shank end and a leading end, said screw leading end being screwed into said cage, and thrust against said screw-engaging surface of said conductor strip in order to electrically connect said conductor wire to said conductor strip by gripping said wire between said wire-gripping surface of said conductor strip and said inside, wire-gripping surface of said cage which extends generally parallel to said wire-gripping surface of said conductor strip, said clamping screw having a screw axis which extends at an acute angle relative to said generally parallel wire-gripping surfaces, said cage including at least one lateral screw-backing element for engaging said clamping screw at least in the vicinity of its leading end to oppose the traverse component of the reaction between said screw and said connector strip tending to urge the leading end of the screw sideways while said screw is being tightened by virtue of said angle between and screw and said screw-engaging surface of said strip, said cage being made of a cut and folded metal sheet comprising a pair of parallel webs interconnected at one end by an obliquely disposed web forming said wire-gripping surface of said cage, and being interconnected at an opposite end by at least one web which extends perpendicularly to said pair of parallel webs and which includes a tapped hole holding and positioning said clamping screw so that said clamping screw extends parallel to said pair of parallel webs, each of said parallel webs including a lateral projection folded against the shank of the screw at least in the vicinity of its leading end pressed against said conductor strip and constituting said at least one lateral screw backing element to avoid setting up a rotary couple between said screw shank and said conductor strip, said cage being placed in said first duct and said cage and said first duct being configured and sized so as to enable limited axial displacement of said cage relative to said strip along said screw axis between positions which correspond to extreme positions for a gap existing between said wire-gripping surfaces of said cage and said strip, and said first duct provides access to turn the screw, said wire-gripping surfaces of said strip and of the cage being disposed opposite an opening of said second duct, said second duct constituting a wire-access duct passing obliquely through said housing in a direction which is parallel to said wire-gripping surfaces, and said conductor strip being carried by a third duct within said insulating material housing intersecting said first and second ducts, and said conductor strip having a portion projecting into said first duct at the intersection of said first and second ducts, and said conductor strip portion extending obliquely parallel to said obliquely disposed web and to said second duct.

2. A screw connection according to claim 1, wherein the cage pair of parallel webs are folded perpendicularly about a central portion which defines said angled wire-gripping surface, said webs have free ends folded back perpendicularly one over the other in order to form a double thickness web provided with said tapped hole receiving said clamping screw, and said lateral screw-backing extensions being cut out tabs projecting from the outside of said pair of parallel webs prior to folding, and folded towards each other against the shank of the screw.

3. A screw connection according to claim 1, wherein said lateral screw-backing extensions are at least partially tapped to engage the thread on the shank of said clamping screw as it is being screwed tight.

4. A screw connection according to claim 1, wherein said screw-engaging surface of said conductor strip is provided with a notch coming into direct contact with the said leading end of said clamping screw and preventing said leading end from sliding over said strip while said screw is being tightened.

5. A screw connection according to claim 4, wherein said leading end of said clamping screw includes a chamfered tip which terminated in a plane circular zone extending perpendicularly to said screw axis, in such a manner as to press in two distinct directions against said conductor strip.

* * * * *